US010661947B2

(12) United States Patent
Bühr et al.

(10) Patent No.: US 10,661,947 B2
(45) Date of Patent: May 26, 2020

(54) POUCH WITH SLIDE-IN POCKET

(71) Applicant: REEMTSMA CIGARETTENFABRIKEN GMBH, Hamburg (DE)

(72) Inventors: Carmen Bühr, Hamburg (DE); Björn Urban, Hamburg (DE)

(73) Assignee: REEMTSMA CIGARETTENFABRIKEN GMBH, Hamburg (DE)

( * ) Notice: Subject to any disclaimer, the term of this patent is extended or adjusted under 35 U.S.C. 154(b) by 335 days.

(21) Appl. No.: 15/518,925

(22) PCT Filed: Jul. 6, 2015

(86) PCT No.: PCT/EP2015/065324
§ 371 (c)(1),
(2) Date: Apr. 13, 2017

(87) PCT Pub. No.: WO2016/058715
PCT Pub. Date: Apr. 21, 2016

(65) Prior Publication Data

US 2017/0259960 A1 Sep. 14, 2017

(30) Foreign Application Priority Data

Oct. 14, 2014 (EP) ..... 14188851

(51) Int. Cl.
*B65D 30/22* (2006.01)
*B65D 30/08* (2006.01)
(Continued)

(52) U.S. Cl.
CPC ..... *B65D 31/12* (2013.01); *A24F 23/02* (2013.01); *A24F 23/04* (2013.01); *B65D 31/02* (2013.01); *B65D 31/04* (2013.01)

(58) Field of Classification Search
CPC ..... B65D 31/12; B65D 31/04; B65D 31/02; A24F 23/04; A24F 23/02
(Continued)

(56) References Cited

U.S. PATENT DOCUMENTS 1,096,771 A * 5/1914 Twining ..... A24F 23/04 206/236
1,280,534 A * 10/1918 Penn ..... A24F 23/04 206/237
(Continued)

FOREIGN PATENT DOCUMENTS

DE 202011001898 U1 4/2011
EP 191382681 4/2008
(Continued)

OTHER PUBLICATIONS

Office Action in corresponding Australian Application 2015333074 dated Jan. 11, 2019, 3 pages.
(Continued)

*Primary Examiner* — Jacob K Ackun
*Assistant Examiner* — Jenine Pagan
(74) *Attorney, Agent, or Firm* — Workman Nydegger

(57) ABSTRACT

The present invention is directed to a pouch (1) for tobacco comprising a first pocket, wherein at least a wall of the pouch is formed of a flexible sheet laminate (6) composed of at least a first and a second layer (61, 62), the pouch further comprising a slide-in pocket (4) formed within the flexible sheet laminate, wherein the slide-in pocket comprises a pocket front wall (42) formed of a part of the first layer (61) of the flexible sheet laminate, a pocket back wall (41) formed of a part of the second layer (62) of the flexible sheet laminate and a first opening (5) arranged in the first layer or the second layer of the flexible sheet laminate, the interior of the slide-in pocket being accessible via the first opening.

15 Claims, 6 Drawing Sheets

(51) Int. Cl.
*A24F 23/02* (2006.01)
*A24F 23/04* (2006.01)

(58) Field of Classification Search
USPC ..... 206/260, 245, 242
See application file for complete search history.

(56) References Cited

U.S. PATENT DOCUMENTS 2,149,030 A * 2/1939 Moore ..... B65D 31/02 206/237
2,271,279 A * 1/1942 Thomas ..... B65D 33/20 206/245
2,537,196 A 1/1951 Tanski
2,867,372 A * 1/1959 Fox ..... B65D 31/12 206/232
3,313,473 A * 4/1967 Witters ..... B65D 33/20 206/260
3,332,603 A * 7/1967 Kamins ..... B65D 33/02 206/260
3,394,870 A * 7/1968 Curtis ..... A24F 23/04 206/260
3,680,768 A * 8/1972 Warren ..... B65D 33/004 229/72
4,648,860 A * 3/1987 Cassey ..... B65D 27/00 229/72
4,711,349 A * 12/1987 Focke ..... B65B 7/08 206/245
4,785,933 A * 11/1988 Focke ..... A24F 23/02 206/260
4,993,845 A * 2/1991 Faltynek ..... B65D 31/12 206/542
5,149,202 A * 9/1992 Dickert ..... B65D 5/4233 383/106
2007/0151876 A1* 7/2007 Wright ..... A24F 23/02 206/245
2010/0177986 A1* 7/2010 Kohn ..... B65D 31/12 383/12
2016/0198764 A1* 7/2016 Suss ..... B65D 33/18 206/260
2017/0006913 A1* 1/2017 Little ..... A24F 23/02

FOREIGN PATENT DOCUMENTS

GB 2208350 A 3/1989
NL 8701152 12/1988
NL 2006781 C 11/2012
WO 2004084659 A1 10/2004

OTHER PUBLICATIONS

Office Action in Corresponding New Zealand Application 729755, dated Oct. 18, 2018, 2 pages.
Office action from corresponding New Zealand Application 729755 dated May 28, 2018, 2 pages.
International Search Report and Written Opinion for PCT/EP2015/065324 dated Oct. 29, 2015, 9 pages.

* cited by examiner

POUCH WITH SLIDE-IN POCKET

CROSS REFERENCE TO RELATED APPLICATIONS

This application is a U.S. Nationalization of PCT Application Number PCT/EP2015/065324, filed on Jul. 6, 2015, which claims priority to European Patent Application No. 14188851.1, filed on Oct. 14, 2014, the entireties of which are incorporated herein by reference.

The present invention is directed to a pouch for tobacco which, in addition to a first pocket to house tobacco, further comprises an integrated slide-in pocket to accommodate objects or articles like e.g. give-aways, commercial products, lighter, matches or a booklet of cigarette paper, as well as to a method of producing the same.

Consumables like e.g. tobacco are often sold in form of a pouch package. Pouches for tobacco as well as methods of manufacturing the same are well known in the art. However, the consumer willing to enjoy a cigarette usually needs further articles in order to prepare and ignite a cigarette prepared from the tobacco in the pouch. It would be advantageous to provide means associated with the tobacco pouch which allows the consumer to carry said additional articles together with the pouch.

Pouches with further pockets to house articles in addition to tobacco are known in the art. Exemplary embodiments are disclosed in DE 20 2011 001 898 U1, NL 8701152 and EP 1 91382681. However, the pouch packages described in the prior art always require the use of additional material which is then welded to a classical pouch in order to form the further pocket. The use of additional material is cost intensive and additional welding steps lead to more complicated manufacturing processes with increased failure rates.

An object of the present invention is to provide a pouch comprising an additional pocket which requires less material and which does not complicate manufacturing processes.

The present invention provides a pouch for tobacco comprising a first pocket, wherein at least a wall of the pouch is formed of a flexible sheet laminate composed of at least a first and a second layer, characterized in that the pouch (1) further comprises a slide-in pocket formed within the flexible sheet laminate, wherein the slide-in pocket comprises:

- a front wall formed of a part of the first layer of the flexible sheet laminate;
- a back wall formed of a part of the second layer of the flexible sheet laminate; and
- a first opening arranged in the first layer or the second layer of the flexible sheet laminate, the interior of the slide-in pocket being accessible via the first opening.

In the pouch of the present invention, the slide-in pocket is formed into one of the walls of the pouch which is formed of a flexible sheet laminate, e.g. the slide-in pocket is integrated into a flexible sheet laminate which is used to form a flap, front wall and/or back wall of the pouch. Front and back wall of the slide-in pocket are formed by different layers of the flexible sheet laminate. The interior of the integrated slide-in pocket is accessible via a first opening which is arranged into the first or the second layer of the flexible sheet laminate.

By doing so, the slide-in pocket is integrated into the pouch without the need for additional material and without the need for further welding steps. Since the slide-in pocket is formed into pre-existing material of the pouch, the slide-in pocket does not stick-out from the surface of the pouch and the slide-in pocket can be positioned freely within the pouch.

It is not necessary that the slide-in pocket is located at a position which allows for successful placement of additional material or which is easily accessible for welding. The process of manufacturing the pouch of the invention is less prone to failure compared to the manufacturing process of prior art pouches comprising an additional pocket because further welding steps to arrange the extra material for the additional pocket are avoided.

The pouch of the invention comprises at least one wall formed of a flexible sheet laminate. There are several types of pouches for tobacco known in the art. There are pouches known where the first pocket is formed only of a front and a back wall, like e.g. in a rolled pouch. Alternatively, the first pocket may be formed of a front wall, a back wall and a bottom wall as well as optionally one or more side walls, like e.g. in a block pouch or stand-up pouch. Optionally, the pouch may comprise a flap which can be regarded as part of the front, back or side wall or which may be provided as separate wall of the pouch. The present invention is not limited to a certain type of pouch and in principle works with all known pouch architectures provided that at least one wall of said pouch is formed of a flexible sheet laminate in which the slide-in pocket is integrated. The pouch of the invention can be formed of a front wall and a back wall and optionally a flap. The pouch of the invention may further comprise a bottom wall and optionally one or more side walls to form the first pocket of the pouch. Preferably, the pouch of the invention comprises a front wall and a back wall opposed to each other and optionally a bottom wall, one or more side walls and/or a flap, wherein at least one of the front wall, the back wall, the bottom wall, the side wall and the flap is formed of the flexible sheet laminate.

The pouch of the invention can comprise a flap and a first pocket defined by opposing front and back walls, wherein at least one of the flap, the front wall and the back wall is formed of a flexible sheet laminate composed of at least a first and a second layer, wherein the pouch further comprises a slide-in pocket formed within the flexible sheet laminate, wherein the slide-in pocket comprises:

- a front wall formed of a part of the first layer of the flexible sheet laminate;
- a back wall formed of a part of the second layer of the flexible sheet laminate; and
- a first opening arranged in the first layer or the second layer of the flexible sheet laminate, the interior of the slide-in pocket being accessible via the first opening.

The pouch of the invention preferably comprises a flap and a first pocket formed by a front wall and a back wall which are opposed to each other. Usually, the side edges of the front and back walls are sealed together, leaving a mouth region through which the interior of the first pocket of the pouch is accessible. The flap is arranged at the mouth region and allows for closing of the first pocket of the pouch by folding the flap over the pocket at or near the mouth. Usually, the flap has a length sufficient to cover the mouth of the first pocket. Preferably, the flap has a length which exceeds the length of the first pocket so that the flap can be efficiently wrapped around the first pocket in order to close the pouch. The pouch may comprise a reclosable seal provided at the mouth of the pocket which makes it possible for the consumer the seal the pocket after accessing the content of the first pocket thereby preventing loss of contents by spillage from the pocket. The reclosable seal also reduces ingress of air into the first pocket and loss of moisture from the contents of the first pocket ensuring that the content remains moist and does not dry out. Thus, tobacco within the first pocket is kept fresh (by the preservation of aroma and moisture) over a prolonged period of time after the time of first use.

Typically, the flap and the back wall of the pouch are formed from a single piece of flexible sheet material, e.g. of flexible sheet laminate. The front wall of the pouch is then built from a second piece of flexible sheet material. In such a case, the first pocket of the pouch can be formed by adhesively bonding a second smaller piece of flexible sheet material, e.g. of flexible sheet laminate, along three of its edges to the first sheet. At least one of the two pieces of flexible sheet material is made of flexible sheet laminate composed of at least a first and a second layer.

However, the pouch of the present invention is preferably formed from a single piece of flexible sheet laminate by folding the front wall part over the back wall part and adhesively bonding the overlapping side edges of the front and back wall to form the first pocket of the pouch. The portion of the single piece of flexible sheet laminate extending beyond the mouth of the first pocket forms the flap which can then be used to fold over the first pocket.

Preferably, the flap, front and back wall of the pouch are all formed of a flexible sheet laminate and even more preferably, flap, front and back wall of the pouch are all formed of one single piece of flexible sheet laminate. If flap, front wall and back wall of the pouch of the invention are made from one single piece of flexible sheet laminate, e.g. in form of a blank, it is easily possible to arrange the slide-in pocket of the invention at any desired position and to provide a pre-prepared blank already comprising the slide-in pocket. Since the slide-in pocket does not stick-out from the surface of the flexible sheet laminate, such a pre-prepared blank can be identical in size and dimension compared to a classical blank without a slide-in pocket of the invention and, thus, such a pre-prepared blank can be processed further into the pouch of the invention by using conventional manufacturing means and processes. Folding as well as welding steps and weld position can remain unaltered compared to classical pouch manufacturing without the integrated slide-in pocket of the invention. Thus, no further adaptation of downstream processing is needed in contrast to conventional pouches with additional pockets.

Alternatively, the front wall and the back wall of the pouch of the invention can be formed of separate pieces of flexible sheet material with the proviso that at least one of them is formed of a flexible sheet laminate. It is possible that only one, either the back wall or the front wall, is formed of a flexible sheet laminate wherein the other is formed of a different flexible sheet material which is not a flexible sheet laminate. This allows saving of material and costs as well as weight because the amount of flexible sheet laminate needed is reduced.

For the pouch of the present invention it is sufficient if only one wall of the pouch like e.g. one of the flap, the front wall and the back wall of the pouch, or a part thereof is formed of a flexible sheet laminate. The remaining parts of the pouch can be formed of a less complex and expensive flexible sheet material. Thus, it is not necessary that the whole of a wall is consisting of a flexible sheet laminate. In order to be formed of a flexible sheet laminate in the sense of the present invention, it is sufficient if at least that part of a wall of the pouch of the invention consists of a flexible sheet laminate in which the slide-in pocket is integrated. In other words, the composition of a given wall of the pouch may be discontinuous in that a part of said wall consists of a flexible sheet laminate whereas the remainder of said wall consists of another flexible sheet material, provided the slide-in pocket is provided in the area of said wall which consists of a flexible sheet laminate.

The pouch of the invention comprises an integrated slide-in pocket formed within the flexible sheet laminate, wherein the slide-in pocket is formed of at least a front wall built of a part of the first layer of the flexible sheet laminate and a back wall built of a part of the second layer of the flexible sheet laminate as well as at least a first opening arranged in one of the first layer or the second layer of the flexible sheet laminate, the interior of the slide-in pocket being accessible via said first opening. The pouch of the invention may also comprise more than one slide-in pocket formed within a flexible sheet laminate.

The slide-in pocket is arranged into the flexible sheet laminate by introducing a first opening. By doing so, the first opening may be formed as a straight slit or a curved slit. Such slits can be easily introduced by technology well known in the art. The first opening may be introduced by physical cutting means or techniques like e.g. blade- or knife based cutting, liquid- or sandjet cutting or laser based cutting. Introduction of the first opening in form of a slit can be easily realized, the depth of the slit can be controlled very precisely as well as any other dimension of the slit. Also positioning of the first opening in form of a slit is straight forward and not limited.

In order to protect the pouch of the invention against damage e.g. due to unexpectedly high forces applied to the first opening, the ends of the first opening may be formed to prevent further tearing through a layer of the flexible sheet laminate. Preferably, the ends of the first opening are designed in the form of a hook or a branched slit. By doing so, the risk of undesired pull-out of the slide-in pocket is reduced and the life-time of the slide-in pocket is extended.

The slide-in pocket of the pouch of the invention may comprise a second opening. The second opening is formed such that the interior of the slide-in pocket is also accessible via the second opening. The presence of a second opening allows for easy introduction and positioning of articles or objects within the slide-in pocket. Preferably, the second opening is formed through the same layer(s) of the flexible sheet laminate as the first opening of the slide-in pocket. The second opening may be arranged opposite to the first opening. By doing so, it is possible to manipulate or position an article or object within the slide-in pocket by accessing the object from two opposing sides. Thus, easy and accurate positioning of articles and objects in the slide-in pocket is improved. The second opening may be formed in the same design as the first opening, i.e. as a straight or curved slit with or without ends prepared to prevent further tearing of a layer of the flexible sheet laminate. The second opening may thereby be formed identical to the first opening; alternatively, it may be formed laterally reversed or corresponding to the appearance of the first opening.

In order to avoid further post-manufacturing steps, it is advantageous if in the area where the slide-in pocket is formed, the first and the second layer of the flexible sheet laminate are not permanently laminated together. By doing so, it is ensured that the slide-in pocket is ready to use upon introduction of the first opening. After introducing a slit at an edge of the area where the slide-in pocket is to be formed, the front and back wall of the slide-in pocket separate from each other without further processing steps, the slide-in pocket is formed and is accessible through the first opening. Preferably, the flexible sheet laminate does not comprise an adhesive between the first and the second layer in the area where the slide-in pocket is formed.

The slide-in pocket of the pouch of the invention may further comprise a dispensing opening. The dispensing opening allows dispensing of a product from a source contained in the slidein pocket. If e.g. a booklet of cigarette papers is introduced into the slide-in pocket, the dispensing opening may allow for dispensing single cigarette papers from the booklet stored in the slide-in pocket. Such a dispensing opening is formed into the front and/or back wall of the slide-in pocket. The exact position and dimension of the dispensing opening depends on the product to be dispensed and the article or object placed into the slide-in pocket from which the product is to be dispensed through the dispensing opening. As already outlined for the first and second opening of the slide-in pocket above, the dispensing opening may be formed as straight or curved slit with or without ends formed to prevent further tearing of a layer of the flexible sheet laminate. Preferably, the width and/or dimension of the dispensing opening are adapted to the product to be dispensed through said dispensing opening.

As already outlined above, the slide-in pocket is not limited in location or position within the pouch of the invention. The slide-in pocket may be arranged on an inner side of the pouch such that it is not accessible from the outside when the pouch is closed by folding the flap. If the slide-in pocket is arranged in this way, loss of articles or objects from the slide-in pocket is prevented when the pouch is closed by the flap. The slide-in pocket is accessible only when the flap is folded open, e.g. cigarette papers are accessible when the pouch is opened, tobacco is accessible and the consumer may be in need of said cigarette papers and content of the slide-in pocket is protected when the pouch is not in use and closed by the flap.

Alternatively, the slide-in pocket may be located on the outside of the pouch of the invention such that the slide-in pocket is only accessible from the outside when the pouch is closed by the flap. If the slide-in pocket is arranged in this way, the content of the slide-in pocket is readily accessible without opening the pouch. Content of the first pocket of the pouch is protected while the slide-in pocket is fully accessible and can be used to store articles or objects. This type of arrangement allows placing, replacing and removing articles or objects while the pouch remains closed. E.g. promotional material may be placed into the slide-in pocket after manufacturing and closing of a tobacco pouch. Said promotional material may be visible to a consumer looking at a closed pouch.

The pouch of the invention is formed of a flexible sheet material with the proviso that at least one of the flap, the front wall and the back wall of the pouch is made from flexible sheet laminate which represents a particular form of a flexible sheet material.

The flexible sheet material comprises or consists of:

- a polymer, preferably a plastic polymer like e.g. a polyolefine, polyethylene, polyester or methylized polyester;
- a metal, a metal alloy, a metal foil and/or a metallized laminate; a paper;

or a combination thereof.

The flexible sheet material may comprise or consist of a polymer having thermoplastic properties such as a polyolefin, e.g. polyethylene or the like. The flexible sheet material can be present as a single layer or in form of a material comprising more than one layer, e.g. in form of a laminate. Thus, the flexible sheet laminate of the pouch of the present invention represents a particular embodiment of a flexible sheet material.

The flexible sheet laminate comprises at least a first layer and a second layer. A layer may be understood to mean an amount of a flexible sheet material which can be processed to be separated from another layer. One layer can be formed of multiple sublayers. Each layer is made of a flexible sheet material as mentioned above, wherein first and second layer may be made of the same or different flexible sheet materials.

The present invention is not limited to a certain architecture or composition of layers and sublayers of the flexible sheet laminate provided the flexible sheet laminate comprises at least a first and a second layer.

Each of the first and second layer of the flexible sheet laminate may independently be formed of one single layer or of multiple sublayers. For example, the first layer can be formed of a single layer, e.g. of a single polyethylene (PE) layer, whereas the second layer is formed of two sublayers, e.g. a methylized polyester (MPET) sublayer and a PE sublayer. In another example, the first layer is composed of two sublayers and the second layer of the flexible sheet laminate is composed of three layers.

It is not necessary that a given flexible sheet laminate is constant in its architecture over the whole area of the flexible sheet laminate. The composition of the flexible sheet laminate may be different in different areas of the laminate, e.g. the first layer may be formed of two sublayers in one area of the laminate wherein in another area of the flexible sheet laminate the first layer is formed of three sublayers.

The first and second layers are laminated together. Preferably, the first and second layer of the flexible sheet laminate are laminated directly together essentially over the entire contact surface between the two layers with the proviso that the first and second layer are not permanently laminated together at the area where the slide-in pocket is formed or is to be formed. Lamination of the first and second layer can be performed by any known lamination method which is compatible with the flexible sheet materials used for the layers. The first and second layers of the flexible sheet laminate can be laminated together by use of an adhesive or by thermal and/or pressure mediated lamination.

In the pouch of the invention, the first layer and/or the second layer of the flexible sheet laminate can be transparent. This can have the effect that the article or object present in the slide-in pocket is visible through at least one of the walls of the slide-in pocket and the design of the pouch material remains visible as long as the slide-in pocket is empty. This opens a lot of design options for the pouch of the invention either alone or in combination with certain articles or objects already placed or to be placed into the slide-in pocket of the pouch.

The present invention is also directed to a pouch of the invention wherein an article or object is comprised in the slide-in pocket. Such an article or object may be a lighter or means to ignite a cigarette, a booklet like e.g. a booklet of cigarette papers or a supplement like e.g. a commercial product, a give-away or an advertising supplement.

Basically, the pouch of the invention can be manufactured by methods already known in the art for the manufacture of classical pouch packages. However, in order to arrive at the pouch of the invention, it is necessary to comprise the steps of providing a flexible sheet laminate comprising at least a first and a second layer for the production of at least one of the walls of the pouch, like e.g. the flap, the front wall or the back wall of the pouch, and of forming the slide-in pocket by introducing at least a first opening through a first layer of the flexible sheet laminate but not through a second layer of the flexible sheet laminate.

In a first preferred method of forming a pouch of the present invention, the method comprises the following steps:

providing a single piece of flexible sheet laminate composed of at least a first and a second layer, wherein the first and second layer are void of an adhesive or are not permanently laminated together at an area where a slide-in pocket is to be formed;

forming the slide-in pocket by introducing at least a first opening extending through the first layer but not through the second layer of the flexible sheet laminate at an edge of the area where the slide-in pocket is to be formed or alternatively by introducing at least a first opening extending through the second layer but not through the first layer of the flexible sheet laminate at an edge of the area where the slide-in pocket is to be formed;

optionally, introducing further openings at the area where the slide-in pocket is to be formed;

folding the single piece of flexible sheet laminate such that the front wall and the back wall of the pouch are located opposite to each other; and sealing side portions of the front and back wall of the pouch to form a first pocket.

In a second preferred method of forming a pouch of the present invention, the method comprises the following steps:

providing a piece of flexible sheet laminate composed of at least a first and a second layer, wherein the first and second layer are void of an adhesive or are not permanently laminated together at an area where a slide-in pocket is to be formed;

forming the slide-in pocket by introducing at least a first opening extending through the first layer but not through the second layer of the flexible sheet laminate at an edge of the area where the slide-in pocket is to be formed or alternatively by introducing at least a first opening extending through the second layer but not through the first layer of the flexible sheet laminate at an edge of the area where the slide-in pocket is to be formed;

optionally, introducing further openings at the area where the slide-in pocket is to be formed;

arranging the piece of flexible sheet laminate with another piece of flexible sheet material such that the front wall and the back wall of the pouch are located opposite to each other; and sealing side portions of the front and back wall of the pouch to form a first pocket.

In the first or second preferred method of the invention, the openings of the slide-in pocket can be introduced into the flexible sheet laminate by physical cutting means or techniques. Appropriate cutting means and techniques are available to the person skilled in the art. Preferred cutting means or techniques comprise blade- or knife based cutting, liquid- or sandjet based cutting or laser based cutting.

The nature of the invention is further exemplified by way of the following figures and examples.

FIGURES

EXAMPLES

Figure 1:
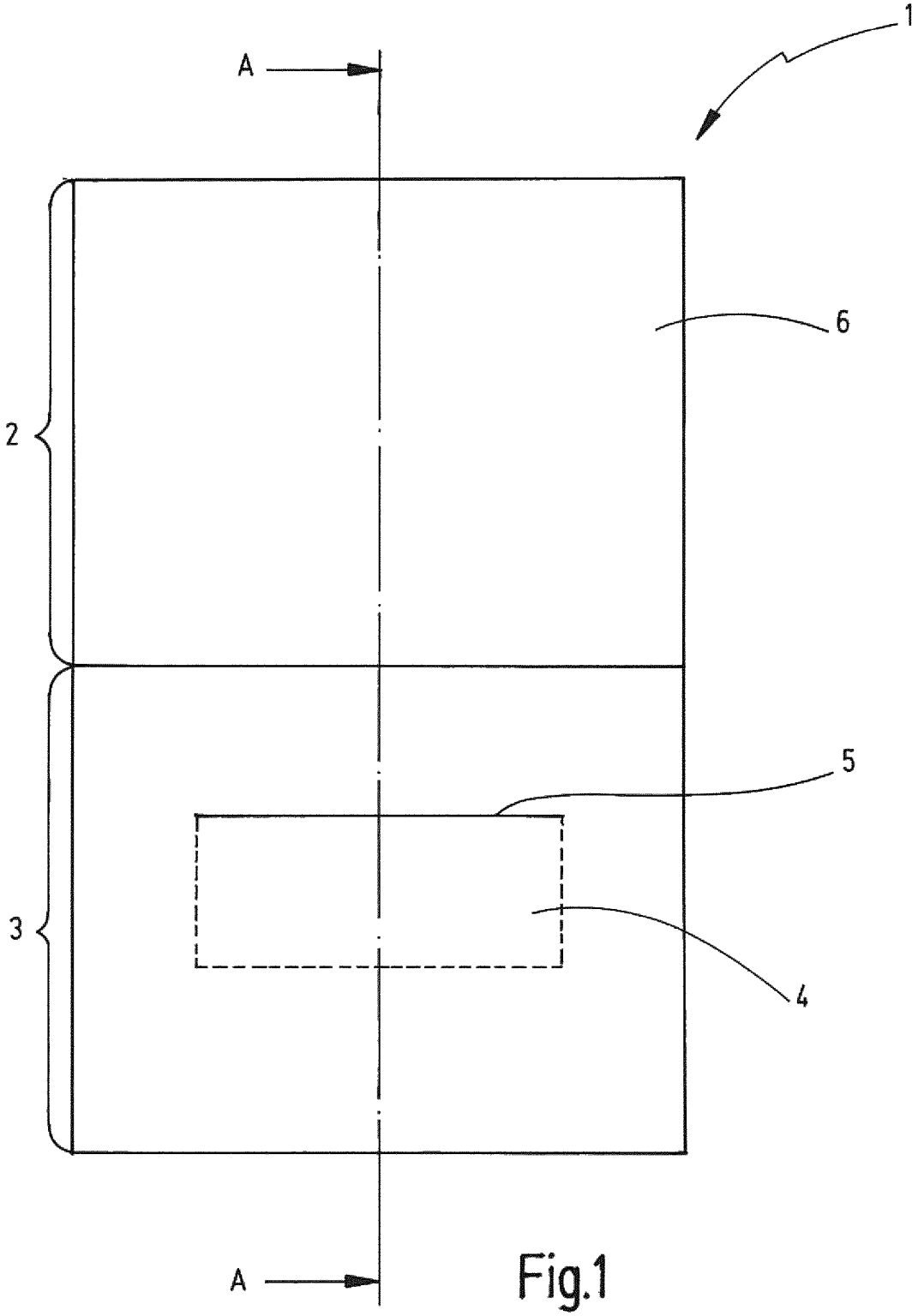
FIG. 1 shows a first embodiment of the pouch of the invention and a cross-sectional line A-A.
Figure 2:
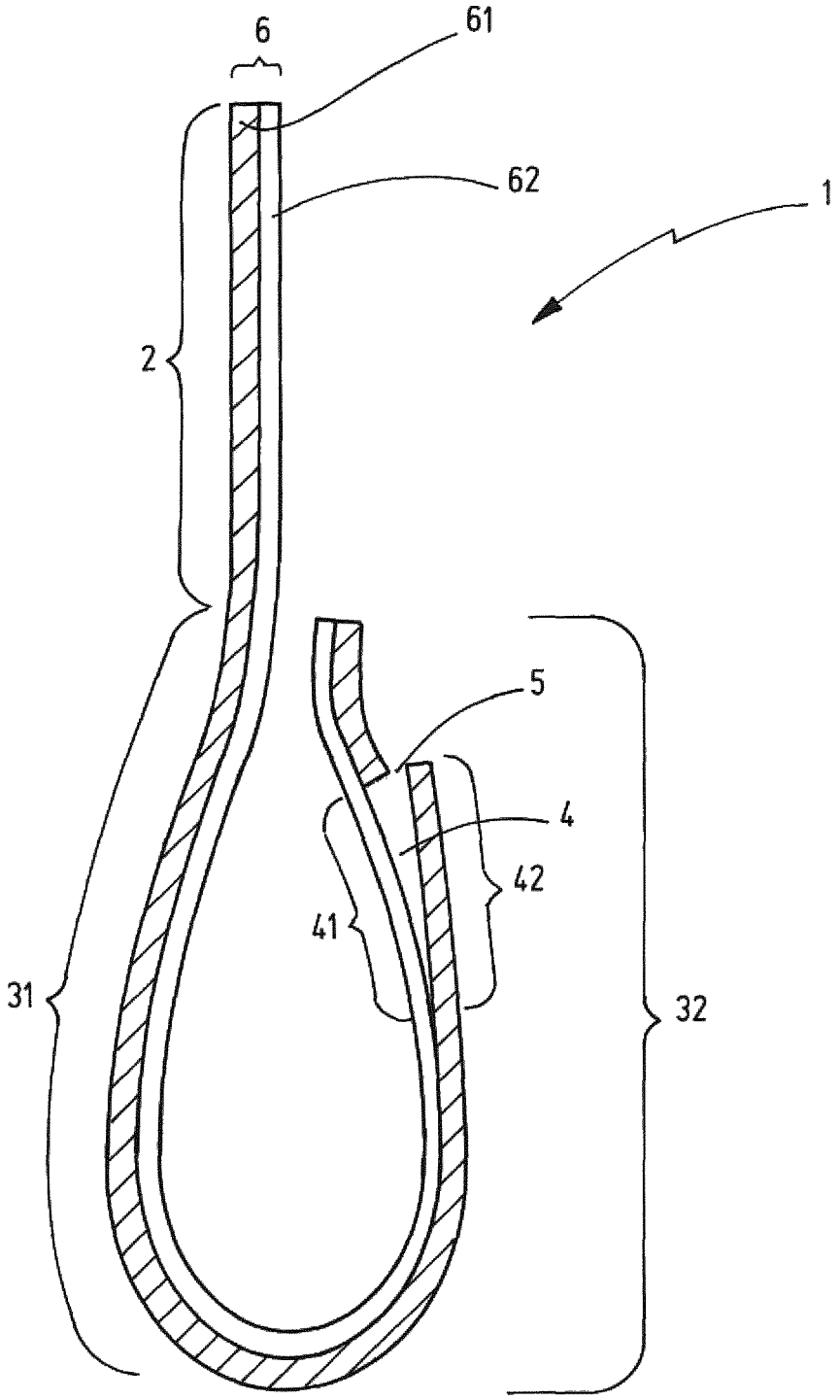
FIG. 2 shows the first embodiment of the pouch of the invention of FIG. 1 in a crosssectional view along line A-A.

In FIGS. 1 and 2 a pouch 1 according to the present invention is shown. The line A-A indicates a cross-section through the pouch 1 of FIG. 1. FIG. 2 shows the pouch 1 of FIG. 1 in a cross-sectional view along the line A-A.

The pouch 1 is formed of one single piece of flexible sheet laminate 6 composed of a first layer 61 and a second layer 62. The pouch 1 comprises a flap 2 and a first pocket 3. The first pocket 3 is built from a back wall 31 and a front wall 32 of the pouch 1. The first pocket 3 is formed by folding back the flexible sheet laminate 6 on itself and sealing the side edges of the overlapping region to build a pocket with a back wall 31, a front wall 32 and a mouth towards the extending part of the flexible sheet laminate 6. Said extending part of the flexible sheet laminate 6 represents the flap 2 of the pouch 1. The flap 2 is shown in an open configuration; however, the flap 2 will be folded over mouth of the first pocket 3 when the pouch 1 is in a closed configuration. On the front wall 32 of the first pocket 3, there is located a slide-in pocket 4 with a first opening 5 which allows access to the interior of the slide-in pocket 4. The slide-in pocket 4 of the pouch 1 is formed of a front wall 42 built by a part of a first layer 61 of the flexible sheet laminate 6 and a back wall 41 built by a part of a second layer 62 of the flexible sheet laminate 6. The first opening 5 is introduced through the first layer 61 of the flexible sheet laminate 6, but does not extend to the second layer 62 of the flexible sheet laminate 6. Via the first opening 5, it is possible to slide in an article or object into the interior of the slide-in pocket 4.

Both, the first and the second layer 61, 62 of the flexible sheet laminate 6 are formed of a polymer which has thermoplastic properties. First layer 61 and second layer 62 are permanently laminated together by heat and/or pressure, except for the area where the slidein pocket 4 is formed. The front wall 42 and the back wall 41 of the slide-in pocket 4 do not comprise adhesive on a surface facing the interior of the slide-in pocket 4.

In FIG. 3 alternative forms of the pouch of the invention are shown.

Figure 3B:
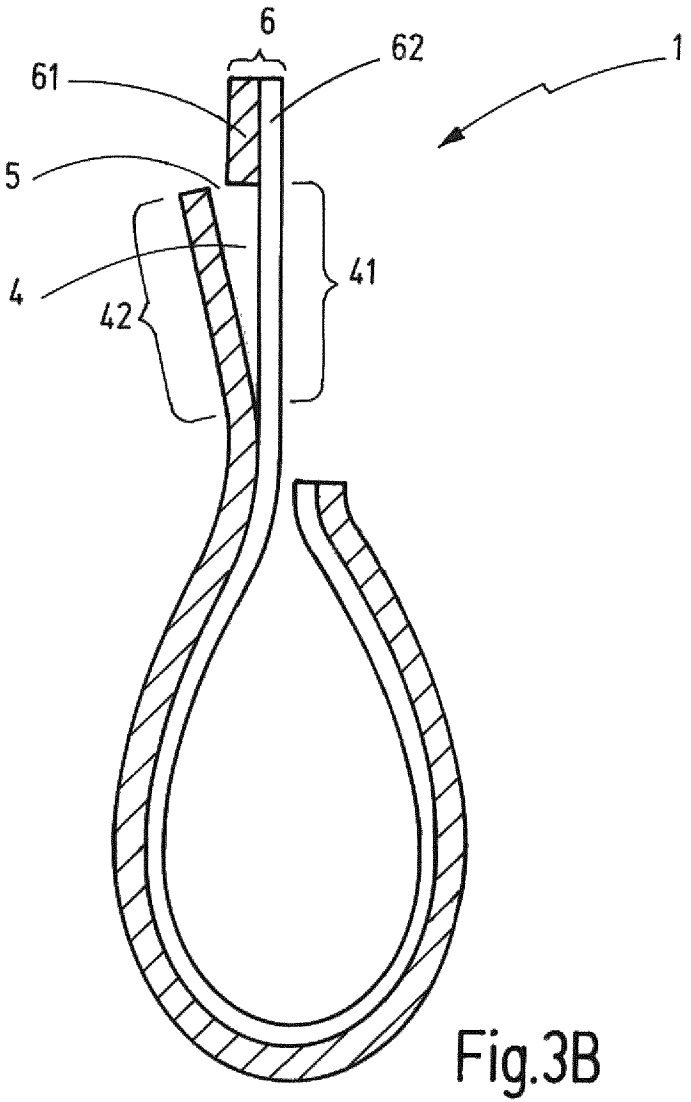
FIG. 3 shows a cross-sectional view of (A) a second embodiment of the pouch of the invention, (B) a third embodiment of the pouch of the invention, (C) a fourth embodiment of the pouch of the invention, (D) a fifth embodiment of the pouch of the invention, (E) a sixth embodiment of the invention and (F) a seventh embodiment of the invention.
Figure 3A:
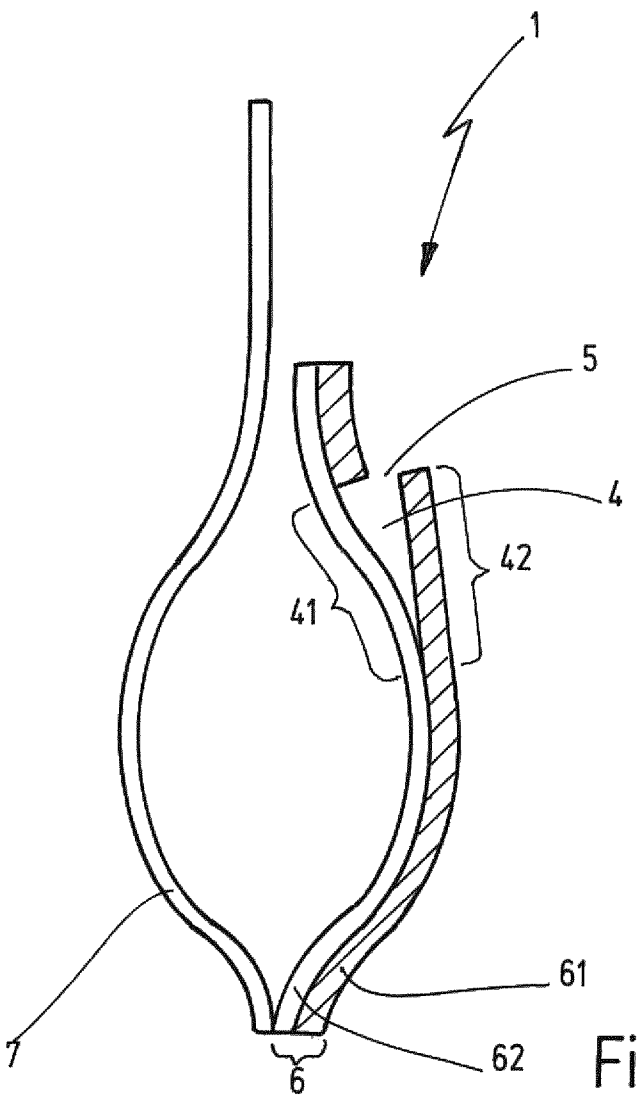

In FIG. 3A a pouch 1 is illustrated which differs from the pouch depicted in FIGS. 1 and 2 in that the pouch 1 is formed from two pieces of flexible sheet material. In the pouch 1 of FIG. 3A the back wall 31 of the first pocket 3 and the flap 2 are not formed of a flexible sheet laminate 6 but from a one-layered flexible sheet 7 made from a material which is different from the flexible sheet laminate 6. This arrangement allows limiting the need for flexible sheet laminate to only the front wall 32 of the first pocket 3, where the slide-in pocket 4 is located in.

In FIG. 3B a pouch 1 is shown which differs from the pouch 1 of FIGS. 1 and 2 in that the slidein pocket 4 and the first opening 5 are arranged within the flap 2 on an outer surface of the pouch 1. This arrangement allows access to the slide-in pocket 4 while the pouch 1 is closed by the flap 2.

Figure 3D:
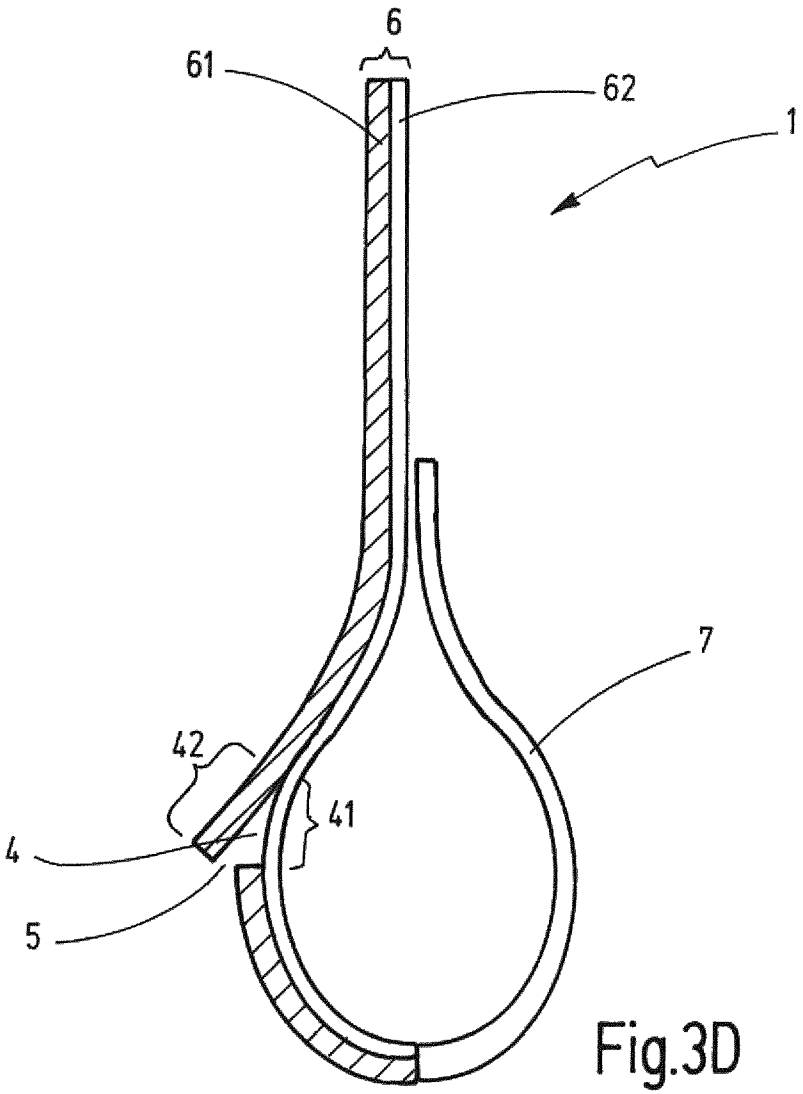
Figure 3C:
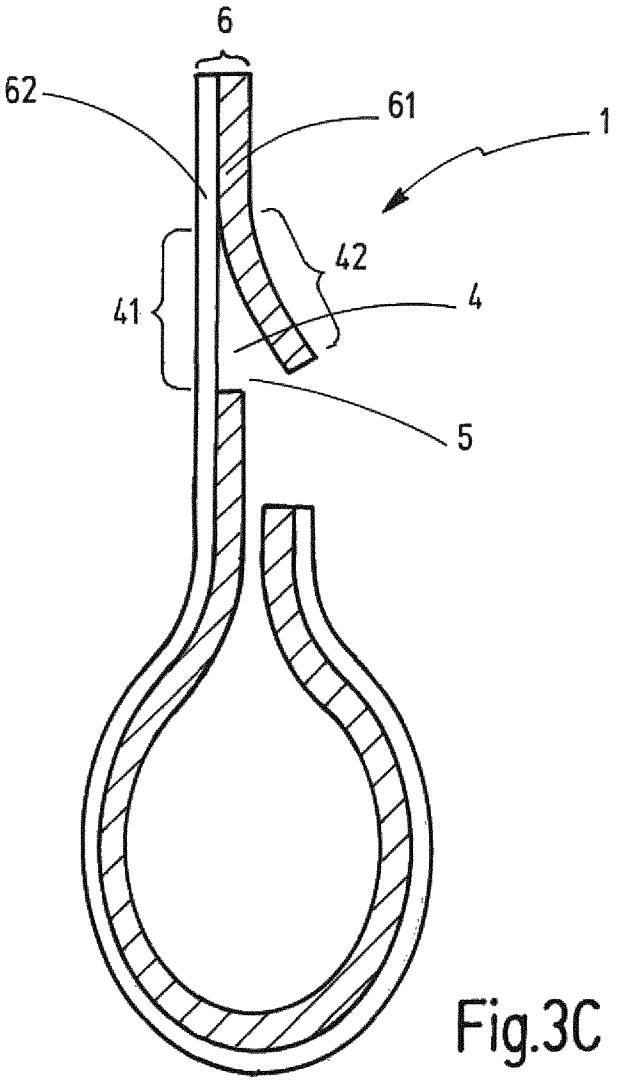

In FIG. 3C a pouch 1 is depicted which differs from the pouch 1 of FIGS. 1 and 2 in that the slide-in pocket 4 is located within the flap 2, the first opening 5 being arranged on a inner surface of the flap 2 such that the slide-in pocket 4 is not accessible while the pouch 1 is in closed by the flap 2. Access to the slide-in pocket 4 is allowed when the pouch 1 is in open configuration.

In FIG. 3D a pouch 1 is illustrated which differs from the pouch 1 shown in FIGS. 1 and 2 in that the pouch 1 is formed from two pieces of flexible sheet material. In the pouch 1 of FIG. 3D the back wall 31 of the first pocket 3 and the flap 2 are formed of a flexible sheet laminate 6 but the front wall 32 of the first pocket 3 is not. The front wall 32 is built from a one-layered flexible sheet 7 made from a material which is different from the flexible sheet laminate 6. The slide-in pocket 4 is located in the back wall 31 of the first pocket 3. This arrangement allows limiting the need for flexible sheet laminate 6 to only the back wall 31, where the slidein pocket 4 is located in, and the flap 2 of the first pocket 3.

Figure 3F:
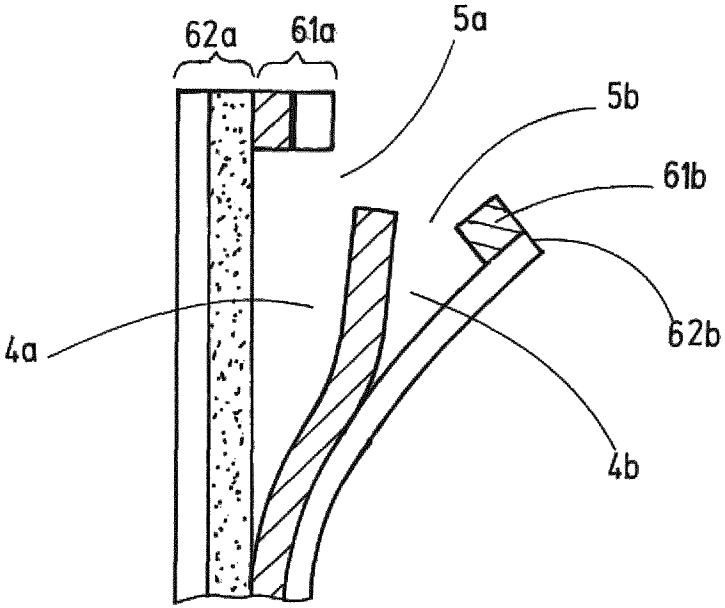
Figure 3E:
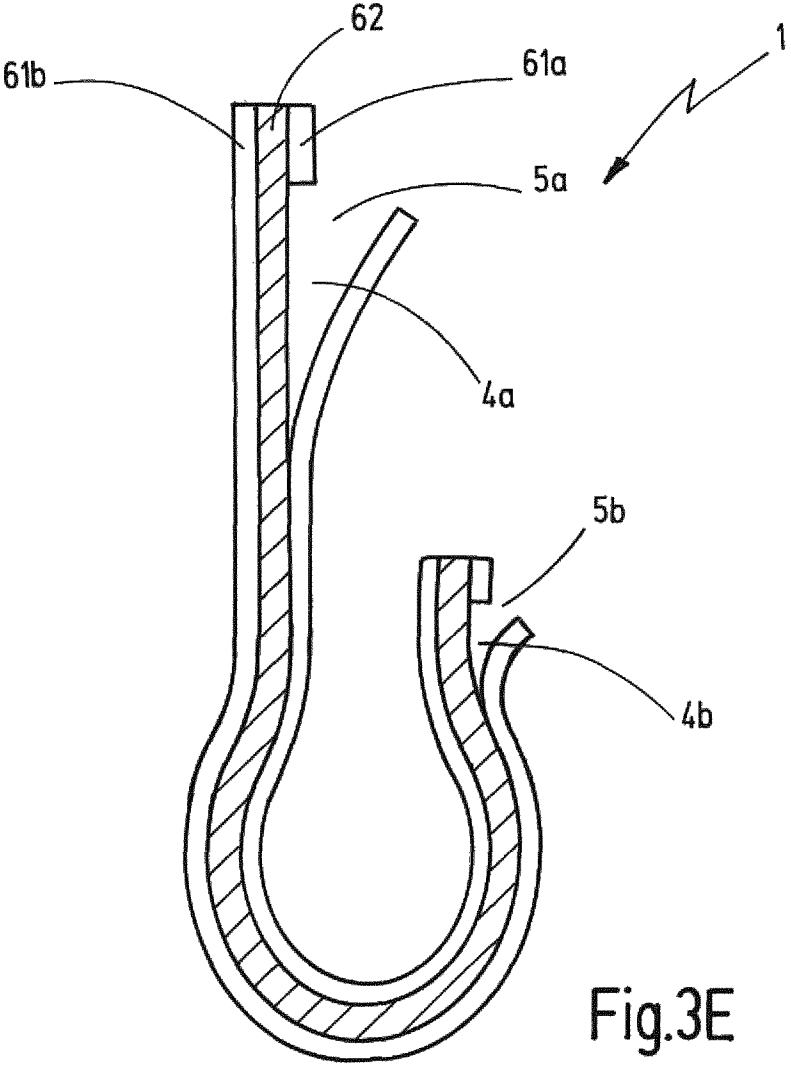

In FIG. 3E a pouch 1 is shown which differs from the pouch given in FIGS. 1 and 2 in that the pouch is formed from a flexible sheet laminate which comprises multiple layers, a first layer 61*a* in which an opening 5*a* allows access to a first slide-in pocket 4*a* formed within the flap and a second layer 61*b* in which an opening 5*b* allows access to a second slide-in pocket 4*b* formed on the outside of the first pocket of the pouch. The first and second layer 61*a* and 61*b* are separated by a layer 62 which serves as second layer for both, the first slide-in pocket 4*a* and the second slide-in pocket 4*b*. In this embodiment, the pouch comprises a flexible sheet laminate comprising multiple layers with two independent slide-in pockets formed into said flexible sheet laminate.

In FIG. 3F a section of a flap of a pouch of the invention is shown which differs from the pouch illustrated in FIG. 3C in that the flexible sheet laminate is composed of multiple layers which allows for the formation of a slide-in pocket in a slide-in pocket. The first slide-in pocket 4*a* is formed by the opening 5*a* in layer 61*a*, wherein the back wall of the first slide-in pocket 4*a* is formed of layer 62*a* and the front wall of the first slide-in pocket is formed of layer 61*a* of the flexible sheet laminate. In this embodiment, a second slide-in pocket 4*b* is formed into the front wall of the first slide-in pocket 4*a* by the opening 5*b*. The back wall of the second slide-in pocket 4*b* is formed by the layer 62*b* of the layer 61*a*, whereas the front wall of the second slide-in pocket 4*b* is formed of layer 61*b* of the layer 61*a*. In this embodiment, the pouch comprises a flexible sheet laminate comprising multiple layers with two slide-in pockets formed in a pocket-in-the-pocket architecture into said flexible sheet laminate. The front wall of the first slide-in pocket 4*a* serves as first and second layer 61*b*, 62*b* of the second slide-in pocket 4*b*.

Figure 4:
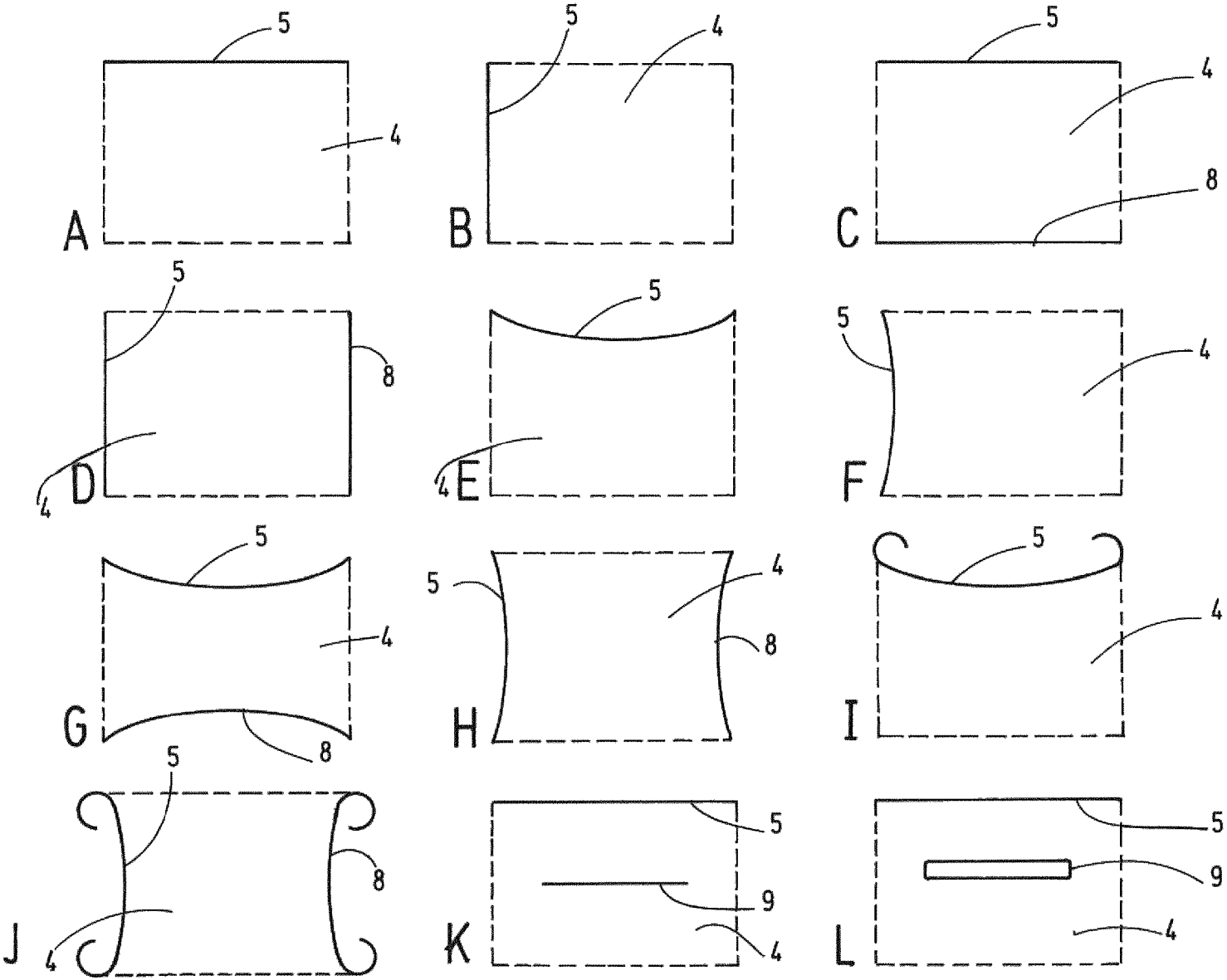
FIG. 4 shows in (A) to (L) various different embodiments of the openings of the slidein pocket of the pouch of the invention.

In FIG. 4 different arrangements of openings of the slide-in pocket 4 are shown.

In FIG. 4A a slide-in pocket 4 is depicted with a first opening 5 in form of a straight slit along a long side of the slide-in pocket 4.

In FIG. 4B a slide-in pocket 4 is shown with a first opening 5 in form of a straight slit along a short side of the slide-in pocket 4.

In FIG. 4C a slide-in pocket 4 is depicted with a first opening 5 and a second opening 8, both in form of a straight slit arranged on opposing long sides of the slide-in pocket 4.

In FIG. 4D a slide-in pocket 4 is depicted with a first opening 5 and a second opening 8, both in form of a straight slit arranged on opposing short sides of the slide-in pocket 4.

In FIG. 4E a slide-in pocket 4 is depicted with a first opening 5 in form of a curved slit along a long side of the slide-in pocket 4.

In FIG. 4F a slide-in pocket 4 is shown with a first opening 5 in form of a curved slit along a short side of the slide-in pocket 4.

In FIG. 4G a slide-in pocket 4 is depicted with a first opening 5 and a second opening 8, both in form of a curved slit arranged on opposing long sides of the slide-in pocket 4.

In FIG. 4H a slide-in pocket 4 is depicted with a first opening 5 and a second opening 8, both in form of a curved slit arranged on opposing short sides of the slide-in pocket 4.

In FIG. 4I a slide-in pocket 4 is depicted with a first opening 5 in form of a curved slit along a long side of the slide-in pocket 4, wherein the ends of the slit of the first opening 5 are formed in a hook.

In FIG. 4J a slide-in pocket 4 is depicted with a first opening 5 and a second opening 8, both in form of a curved slit arranged on opposing short sides of the slide-in pocket 4, wherein the ends of the slits of the first opening 5 and the second opening 8 are formed in a hook.

In FIG. 4K a slide-in pocket 4 is shown with a first opening 5 in form of a straight slit along a long side of the slide-in pocket 4. The slide-in pocket 4 further comprises a dispensing opening 9 in form of a straight slit.

In FIG. 4L a slide-in pocket 4 is shown with a first opening 5 in form of a straight slit along a long side of the slide-in pocket 4. The slide-in pocket 4 further comprises a dispensing opening 9 in form of a straight slit. Compared to the embodiment of FIG. 4K, the width of the slit of the dispensing opening 9 is enlarged.

The invention claimed is:

1. A pouch for tobacco comprising a first pocket and a flap, wherein at least a wall of the pouch is formed of a flexible sheet laminate composed of at least a first and a second layer, wherein the pouch further comprises a slide-in pocket formed within the flexible sheet laminate of a wall of the pouch, wherein the slide-in pocket comprises:

a pocket front wall formed of a part of the first layer of the flexible sheet laminate;

a pocket back wall formed of a part of the second layer of the flexible sheet laminate; and a first opening arranged in the first layer or the second layer of the flexible sheet laminate forming a mouth region through which the interior of the slide-in pocket is accessible, wherein side edges of the pocket front wall and the pocket back wall on either side of the mouth region are sealed together and, in the area where the slide-in pocket is formed, the flexible sheet laminate is void of an adhesive between the first layer and the second layer and the first layer and the second layer are not permanently laminated together; and wherein the flap being arranged adjacent the mouth region and allowing for closing of the slide-in pocket by folding the flap over the slide-in pocket at the mouth region.

2. The pouch of claim 1, wherein all walls of the pouch are formed of the flexible sheet laminate.

3. The pouch of claim 1, wherein the first opening of the slide-in pocket is formed as a straight or curved slit.

4. The pouch of claim 1, wherein the first opening of the slide-in pocket comprises ends formed to prevent further tearing of the first layer of the flexible sheet laminate and preferably the ends are arranged in the form of a hook or branched slit.

5. The pouch of claim 1, wherein the slide-in pocket comprises a second opening, the interior of the slide-in pocket being accessible via the second opening and preferably the second opening being arranged opposite the first opening.

6. The pouch of claim 5, wherein the second opening is provided in a format identical or laterally reversed to the first opening.

7. The pouch of claim 1, wherein the slide-in pocket further comprises a dispensing opening formed into the pocket front and/or pocket back wall of the slide-in pocket.

8. The pouch of claim 7, wherein the dispensing opening is provided as straight or curved slit.

9. The pouch of claim 1, wherein the pouch comprises more than one slide-in pocket formed within the flexible sheet laminate.

10. The pouch of claim 1, wherein the slide-in pocket is located on an inner side of the pouch and is not accessible from the outside when the pouch is closed.

11. The pouch of claim 1, wherein the slide-in pocket is located on the outside of the pouch and is accessible from the outside when the pouch is closed.

12. The pouch of claim 1, wherein the first and/or the second layer of the flexible sheet laminate independently from each other consists of a polymer, a metal and/or a paper.

13. The pouch of claim 1, wherein the first layer and/or the second layer of the flexible sheet laminate is transparent.

14. The pouch of claim 1, wherein the flap, the front wall and the back wall of the pouch are all part of a single piece of flexible sheet laminate, wherein the front wall is folded against the back wall of the pouch to build the first pocket.

15. The pouch of claim 1, wherein the front wall and the back wall of the pouch are formed of separate pieces of flexible sheet material.

* * * * *